United States Patent [19]

Nelson

[11] 4,357,648

[45] Nov. 2, 1982

[54] RECHARGEABLE FLASHLIGHT

[75] Inventor: Norman C. Nelson, Newberry Springs, Calif.

[73] Assignee: Kel-Lite Industries, Inc., Barstow, Calif.

[21] Appl. No.: 237,451

[22] Filed: Feb. 23, 1981

Related U.S. Application Data

[63] Continuation-in-part of Ser. No. 119,787, Feb. 8, 1980, abandoned, and a continuation of Ser. No. 5,322, Jan. 22, 1979, abandoned.

[51] Int. Cl.[3] ..... F21L 7/00

[52] U.S. Cl. ..... 362/183; 362/184; 362/205; 362/207

[58] Field of Search ..... 362/183, 184, 205, 207

[56] References Cited

U.S. PATENT DOCUMENTS 3,233,092 2/1966 Umholtz ..... 362/183

4,171,534 10/1979 Strowe ..... 362/183

*Primary Examiner*—Stephen J. Lechert, Jr.

*Attorney, Agent, or Firm*—Gene W. Arant; Paul H. Ware

[57] ABSTRACT

A flashlight is equipped with rechargeable batteries inside its main housing. A removable tail cap contains an electronic circuit for recharging the batteries, the circuit being actuated and energized by means of a switch assembly which is accessible through the outer end of the tail cap.

A mechanical isolation means is included for protecting the electronic circuit from being damaged by any physical movement of the batteries that may occur.

One embodiment of the invention also includes a spare bulb holder assembly which also constitutes the mechanical isolation means.

11 Claims, 15 Drawing Figures

9
9
10
10
82
120
123
111
113
112
115
110
180
181
182
127
65
63
61
60
100
42
82
78'
78
72
126
125
74
73
75
122
70
53
44
68
43
45
150
52
123
128
48
130
35
132
46

RECHARGEABLE FLASHLIGHT

This application is a continuation-in-part of my prior copending application Ser. No. 06/119,787 filed Feb. 8, 1980 and subsequently abandoned and a continuation of my still earlier copending application Ser. No. 5,322 filed Jan. 22, 1979 and subsequently abandoned.

BACKGROUND OF THE INVENTION

Rechargeable flashlights have been known and used for some time. Many flashlights are not constructed in a mechanically rugged fashion. The present invention relates to rechargeable flashlights which are distinguished by their rugged mechanical construction.

Many flashlights are constructed with a battery housing or casing that is made of an insulating material, for example, plastic. Special provision must then be made for a return current pathway for the lighting current. The present invention in its preferred form is directed to the type of flashlight construction that includes a metal housing for the battery. The metal housing itself is then used to provide the return current pathway for the illuminating current.

My U.S. Pat. No. 3,737,649 shows a flashlight of this type. As shown in that patent the metal housing for the batteries is of cylindrical configuration and threaded on its rearward end. A metal tail cap has a closed rearward end and is threaded at its open forward end. A compression spring carried by the tail cap engages the rearward end of the rearmost one of the batteries. When the tail cap is tightened on the threads of the metal housing, the compression spring ensures a good electrical contact between each two adjacent ones of the batteries. It also provides a current pathway from the rearmost battery to the closed end of the tail cap.

In my U.S. Pat. No. 3,829,676 I have shown how a spare bulb for the flashlight can be carried inside the flashlight itself, simply by storing it inside the compression spring in a space that would otherwise be vacant.

In my U.S. Pat. No. 3,890,555 I have also shown a type of recharging circuit that can be used for the recharging of a rechargeable flashlight. According to the teaching of that patent the flashlight that is to be recharged is temporarily stored in a special housing devised for that express purpose, and of which the recharging circuit is a part.

U.S. Pat. No. 4,115,842 issued to Keller also shows a rechargeable flashlight supported in a special holder. Again, a recharging circuit is supported inside the holder.

According to the present invention the recharging circuit is contained within the housing of the flashlight itself. It is therefore not necessary to utilize a special holder for either the flashlight or the recharger circuit.

The object of the invention, therefore, is to provide a flashlight with built-in recharger circuit, which is economical to manufacture, which protects the recharger circuit from mechanical damage, and which is also convenient and reliable in its operation.

SUMMARY OF THE INVENTION

According to the present invention a flashlight of the type having rechargeable batteries, a metal housing for the batteries, a metal tail cap for the rearward end of the housing, and a compression spring for holding the batteries in place, is provided with a modified and improved tail cap assembly which incorporates a built-in recharger circuit.

More specifically, a recharger circuit is supported within the metal tail cap. A switch means is also supported inside the tail cap, in close cooperative relationship to the recharger circuit. An opening is provided in the closed end of the tail cap. The arrangement and operation of the switch means are such that, upon insertion of a power plug through the opening into the interior of the tail cap, the normal lighting circuit of the flashlight is interrupted and in its place a new circuit loop is created which causes a charging current to be supplied to the flashlight batteries.

An important feature of the invention is the fact that the modified improved tail cap assembly becomes a useful separate entity. That is, it may be used as a replacement for the tail caps of previously manufactured flashlights that were not originally intended to be rechargeable, but which become so when my new tail cap assembly is added into them.

Another important feature of the invention is a novel internal arrangement of the mechanism which provides mechanical isolation of the delicate electronic parts of the charger both from vibration and from rearward forces due to the movement of the batteries, while at the same time providing necessary electrical continuity.

DRAWING SUMMARY

FIRST EMBODIMENT

Reference is now made to drawings FIGS. 1-7 and 11-14 illustrating a first embodiment of the invention, which is a self-contained rechargeable flashlight using size "C" batteries.

Figures 1, 2, 3:
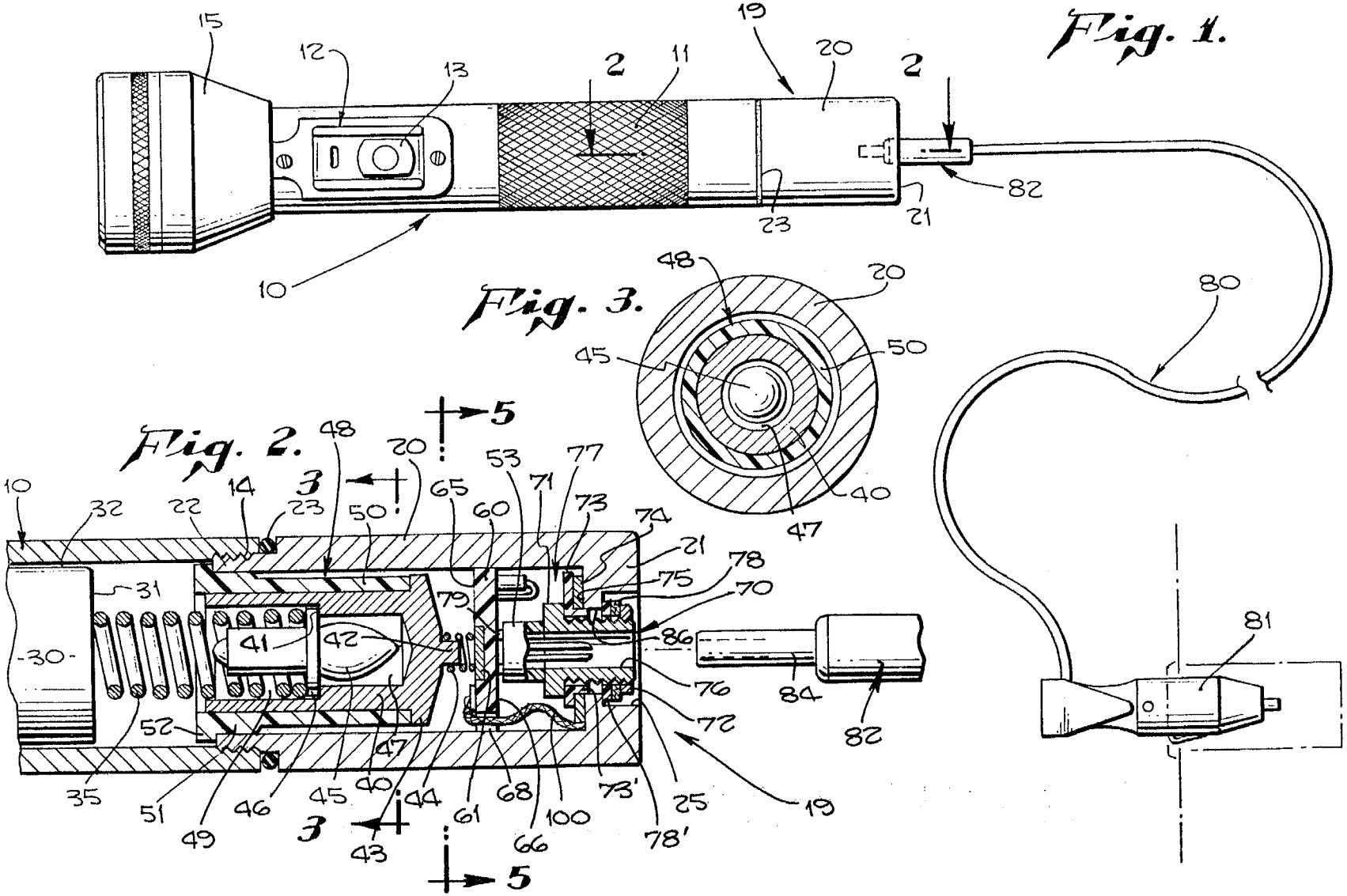
FIG. 1 is a plan view of a rechargeable flashlight and associated power cord, in accordance with a first embodiment of the invention.
FIG. 2 is a cross sectional view of the tail portion of the flashlight taken on the line 2—2 of FIG. 1.
FIG. 3 is a cross sectional view of the tail cap assembly taken on line 3—3 of FIG. 2.

The assembled flashlight FIG. 1 includes a conventional flashlight forward section 10, containing a plurality of batteries 30, compression spring 35, and a rear tail cap assembly 19. For the purpose of illustration, only the rear portion of the flashlight is shown beginning at the midpoint of the rearmost battery in FIGS. 2, 9, 11, 14.

The tail cap assembly 19 includes a bulb holder assembly 48, a charger circuit assembly 77, a switch assembly 70 and a tail cap 20.

MECHANICAL PACKAGING ARRANGEMENT

Figures 4, 5:
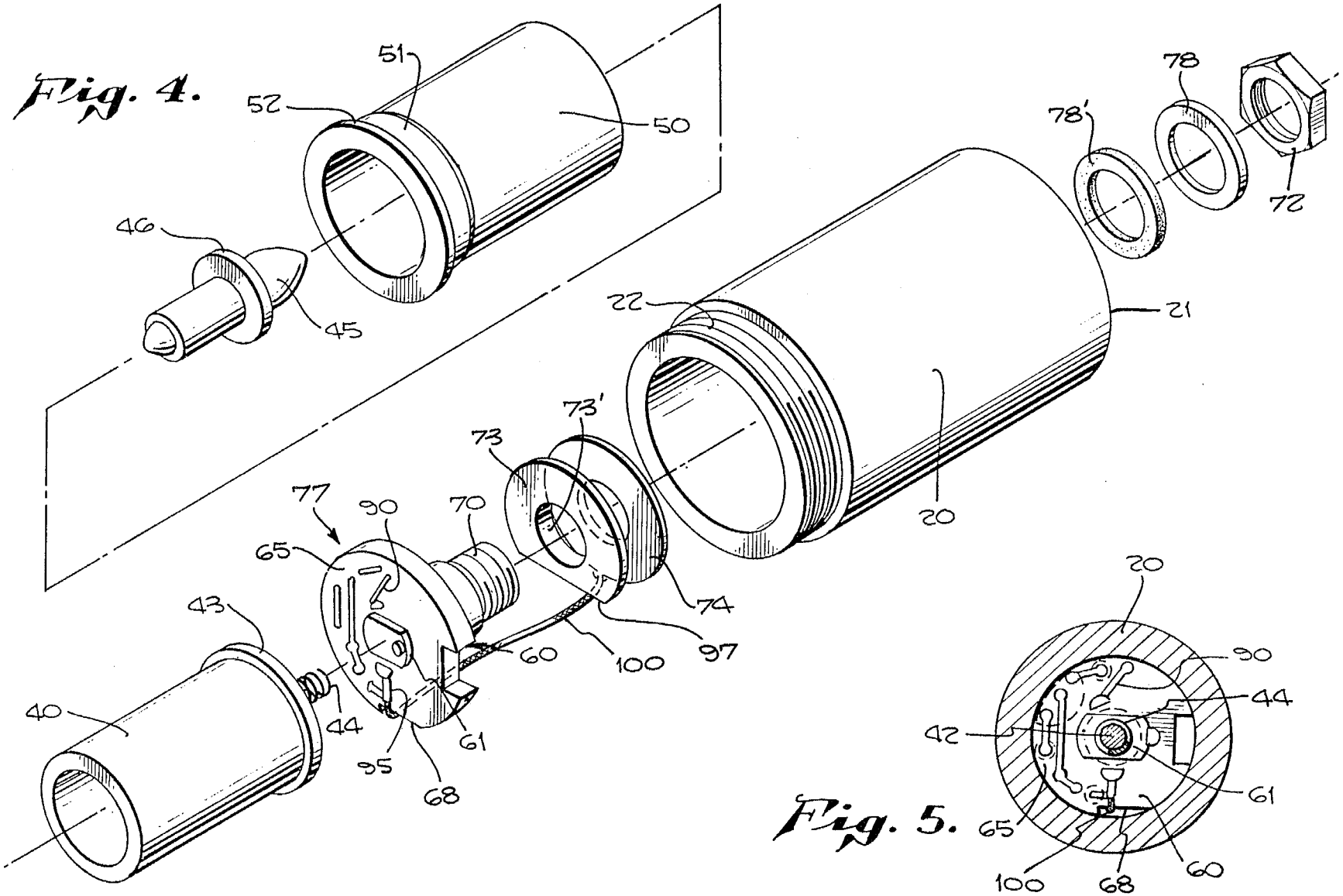
FIG. 4 is an exploded view of the mechanical parts of the tail cap assembly.
FIG. 5 is a cross sectional view of the tail cap on line 5—5 of FIG. 2, showing the printed circuit board.
Figures 8, 9, 10:
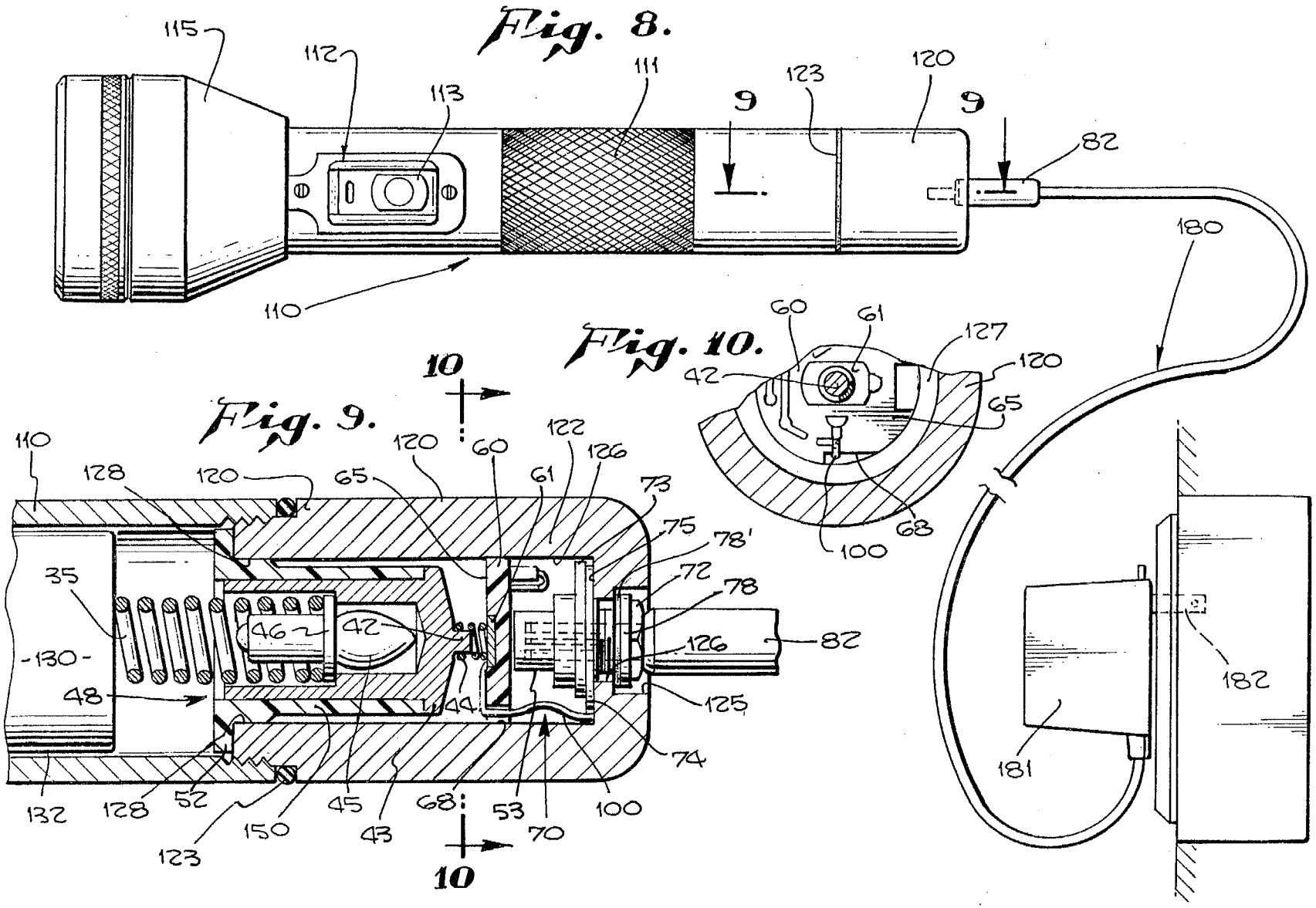
FIG. 8 is a plan view of a flashlight and charging cord in accordance with a second embodiment of the invention.
FIG. 9 is a cross sectional view of the tail portion of the flashlight taken on the line 9—9 of FIG. 8.
FIG. 10 is a fragmentary cross sectional view of the tail cap taken on line 10—10 of FIG. 9.

Construction of the bulb holder assembly 48 will now be described in detail. As shown in FIGS. 2, 3 and 4 bulb housing 40 is of a generally cup-shaped configuration having a closed end in the rearward portion and an open end in the forward portion. The rearward portion has an integrally formed annular rim 43 formed on its exterior side, located at the extreme rearward end portion. Centrally located on the closed end of the rear portion is a protuberance 42 which is formed as an integral part of the bulb housing 40. Protuberance 42 is circular in shape and sufficient in length and diameter to support a connecting spring 44. The inside diameter of the bulb housing 40 is smaller in the region of the rearward portion than in the forward region. This difference in thickness results in an internal shoulder 41 located about the midpoint of the bulb housing 40. The area rearward of the shoulder 41 forms an internal cavity 47 that provides a storage area for the glass portion of spare bulb 45. The area forward of shoulder 41 forms an internal cavity 49 which accommodates the metal ridge 46 of spare bulb 45. While shoulder 41 normally forms a mounting support for the spare bulb, it also forms a support for spring 35. The forward end of spring 35 presses against the rear of the last battery 30. The rearward end presses against either shoulder 41 or metal ridge 46 of bulb 45, if such is being stored in bulb housing 40. Spring 35 is made of metal so that in addition to supporting batteries 30, it may also conduct electrical current between the negative terminal 31 of battery 30 and the ridge 46 of spare bulb 45 or shoulder 41 of the bulb housing 40. Spring 35 is of such construction that it can fully absorb any forces caused by movement of batteries 30. As can be seen in FIGS. 2 and 9 the exterior of bulb housing 40 is partially covered by an annular sleeve 50, which extends forward from rim 43 to some distance beyond the forward end of bulb housing 40. Sleeve 50 is constructed of a non-conducting material and functions to insulate the bulb housing 40 from end cap 20. The material must also be rigid enough to support bulb housing 40 within tail cap 20. Sleeve 50 is designed so that the inside diameter is only slightly larger than bulb housing 40. The outside diameter has three different dimensions. The outside diameter of the rear section of sleeve 50 is approximately the same as housing flange 43. Immediately in front of the rear section is an expanded section 51 which is of such diameter that it will cause a tight fit between tail cap 20 and bulb housing 40 when the bulb holder assembly 48 is inserted in tail cap 20. At the forward end of sleeve 50 is lip 52 which has an outside diameter greater than the inside diameter of tail cap 20. The purpose of lip 52 is to prevent sleeve 50 from entering tail cap 20 beyond a predetermined point.

CHARGER CIRCUIT ASSEMBLY

Construction of the charger circuit assembly will now be described in detail. As shown in FIG. 4 the charger assembly consists of a printed circuit board assembly 60 and switch assembly 70.

Figure 6:
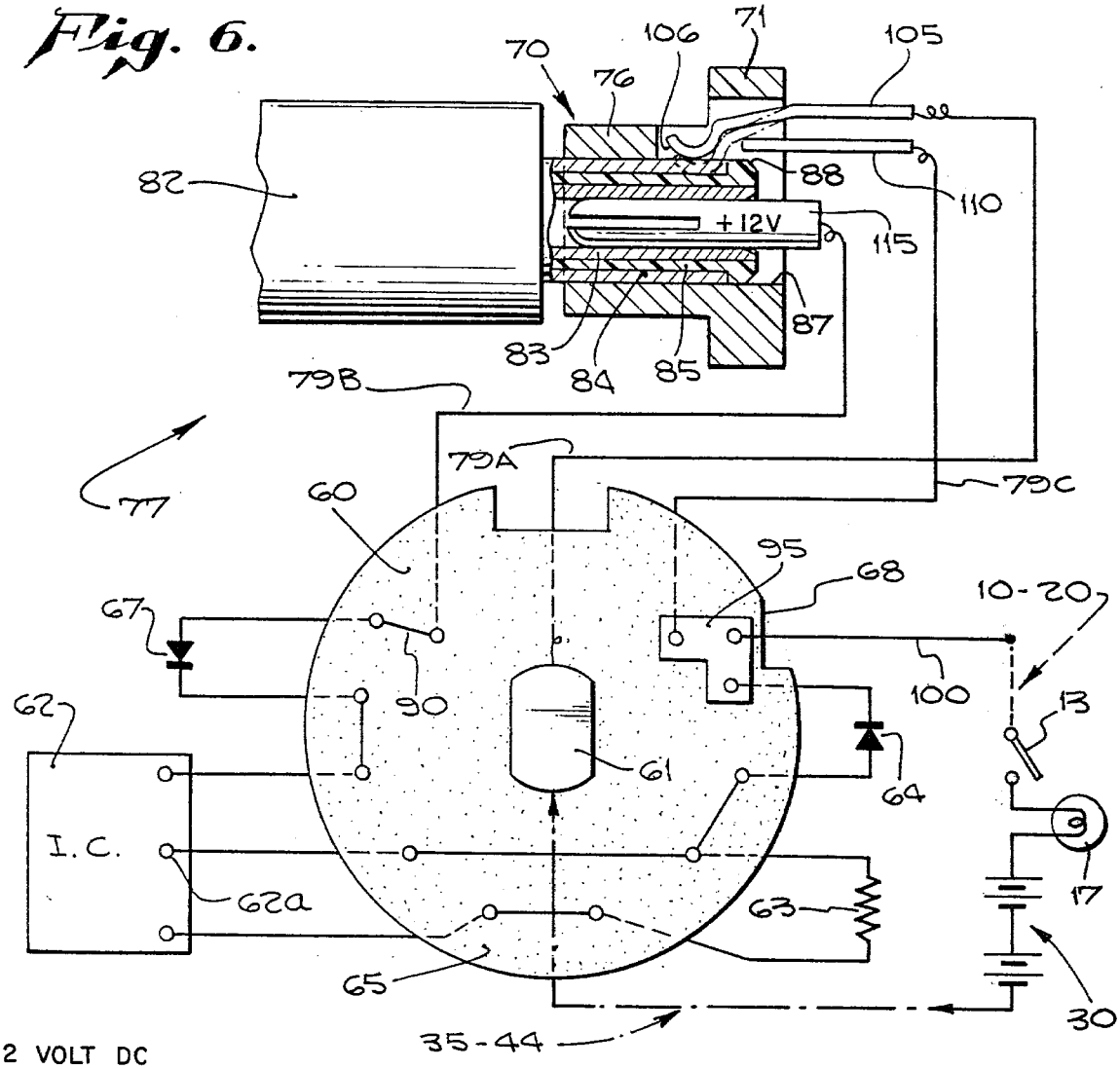
FIG. 6 is a cross sectional showing of the mechanical parts of the switching members together with a schematic diagram of the associated electrical circuit.

As shown in FIGS. 2 and 4 the printed circuit board 60 is generally circular in shape and of such size that it may be located within the tail cap perpendicular to the tail cap inner walls. As shown in FIG. 6 circuit board 60 has a notch cut into one edge in order to allow connecting wire 100 to pass around the edge of the board and at the same time clear the tail cap inner wall. On the forward side 65 of printed circuit board 60 there is a metal plate 61 that is centrally located so that it is aligned with spring 44 and connection will result when bulb holder assembly 48 is inserted and pressed into place. Electronic components are located on the rearward side 66 of printed circuit board 60.

SWITCH ASSEMBLY

As shown in FIG. 2, switch assembly 70 is centrally located to the circuit board 60 and also is attached to tail cap 20 at its rearward end. Switch assembly 70 is of standard design such as Switchcraft Kit 712A. The forward end of switch assembly 70 is attached to the printed circuit board 60 by way of P.C. terminals 79 A, B, C, which extend forward from switch assembly 70. P.C. terminals are inserted through pre-aligned holes in printed circuit board 60 and are mechanically and electrically attached by appropriately placed solder terminals on the forward side 65 of circuit board 60. As can be seen in FIGS. 2 and 4, the rearward portion of switch assembly 70 is centrally located and attached to tail cap 20. Switch assembly 70 includes metal tube 76, various insulating and metal washers, electrodes and locking nut 72. Metal tube 76 is a metallic sleeve with a smooth inner surface and screw threads on its exterior surface. Metal tube 76 has an integrally formed shoulder 71 near its forward end. Immediately rearward of shoulder 71 is an insulator 73 which has an integrally formed annular rim 73' centrally located to accommodate metal tube 76. Additionally rim 73' extends rearwardly into opening 86 which is located within bore 25 of tail cap 20. See FIG. 2. When rim 73' is in this position, it acts to center metal tube 76 and also to insulate metal tube 76 from tail cap 20. Between insulator 73 and tail cap 20, metal washer 74 is circumferentially located around metal tube 76. When switch assembly 70 is mounted within tail cap 20, metal washer 74 is sandwiched between insulator 73 and inner rear surface 75 of tail cap 20. This face to face relationship puts the inner rear surface 75 and metal washer 74 in electrical contact. Additionally, metal washer 74 is in electrical contact with terminal 95 on printed circuit board 60 by way of electrical conductor 100, see FIG. 4. As can also be seen in FIG. 4, insulator 73 is especially designed with a cutaway section 97, which allows conductor 100 to pass through insulator 73. As can be seen in FIG. 2, after metal tube 76 has been inserted through bore 25, insulator 73 and washer 78 are circumferentially mounted on the protruding end of metal tube 76. Finally switch assembly 70 is fastened to tail cap 20 by lock nut 72 secured to the threaded end of tube 76.

As shown in FIG. 6, switch assembly 70 contains metal contact points 105 and 110, located within opening 87 in metal tube 76. The forward ends of contact points 105 and 110 extend to circuit board 60 through leads 79A, 79C and are mechanically and electrically fastened at terminals 61 and 95 respectively, forming vertical support for circuit board 60. The rearward ends of contact points 105 and 110 are positioned within opening 87 of metal tube 76. As can be seen in FIG. 6, contact point 110 is stationary and fairly rigid, while contact point 105 is flexible and can be selectively moved into or out of contact with contact point 110. This selection is determined by whether the flashlight is being charged or is in use. Separate from the above mentioned contact points switch assembly 70 also has a centrally located center pin 115. The forward end of pin 115 is attached through lead 79B to terminal 90, on circuit board 60, providing mechanical support. The rearward portion of pin 115 is centrally located within metal tube 76 due to being fixed in place by plastic insulation 85.

As shown in FIG. 2, switch assembly 70 also has a removable power plug assembly 82, which is inserted into metal tube 76 when the flashlight is being charged. Power plug assembly 82 includes an outer contact ring 84, an inner contact ring 83 and a power cable 80. In order to charge the flashlight plug assembly 82 is slidably inserted within switch assembly 70. Outer ring 84 outside diameter is slightly smaller than the inside diameter of metal tube 76. Inner sleeve 83 is slightly smaller than the normally expanded diameter of central pin 115. Outer ring 84 is electrically connected to the negative terminal of the charging source by way of power cable 80, while the inner sleeve 83 is connected to the positive terminal. Power cable 80 is connected to the charging source directly by way of plug 81.

TAIL CAP

The tail cap assembly 19 will now be described in detail. Tail cap 20 is a cup-shaped metal sleeve with a closed rearward end 21 and an open forward end 22. The external diameter of tail cap 20 is the same as body 10 of the flashlight. The internal diameter of tail cap 20 is of sufficient size to accommodate circuit board 60 and also to bind plastic sleeve 50 along its expanded section 51, thereby preventing movement of the bulb holder assembly 48. The extreme forward portion 22 of tail cap 20 has a reduced outside diameter containing threaded section 14 which allows tail cap assembly 19 to be threadedly mounted into flashlight body 10. Tail cap 20 forward portion 22 also carries an external O-ring seal 23 between the tail cap 20 and flashlight body 10 to prevent water leakage into the flashlight. As can be seen in FIG. 2, the rearward portion of tail cap 20 is cup-shaped and partially open due to a centrally located opening 86 that accommodates the mounting of switch assembly 70. Opening 86 is recessed into the rear wall 21 by bore 25 resulting in a flat rear outside surface.

In this description the housing 10 and tail cap 20 have been described as separate entities. However, the term "housing" may also be used in a more general sense to refer to the entire flashlight enclosure.

MECHANICAL INTERACTION

Mechanical interaction between the main body of the flashlight and the bulb holder assembly 48 will now be described in detail. As shown in FIG. 2, when tail cap assembly 19 is threadedly mounted on flashlight body 10, the rear end of the last battery 30 in the chain comes in contact with spring 35. Spring 35 at its forward end presses against the rear surface 31 of battery 30 and at its rearward end presses against either metal flange 46 of spare bulb or shoulder 41 of bulb housing 40.

Figure 11:
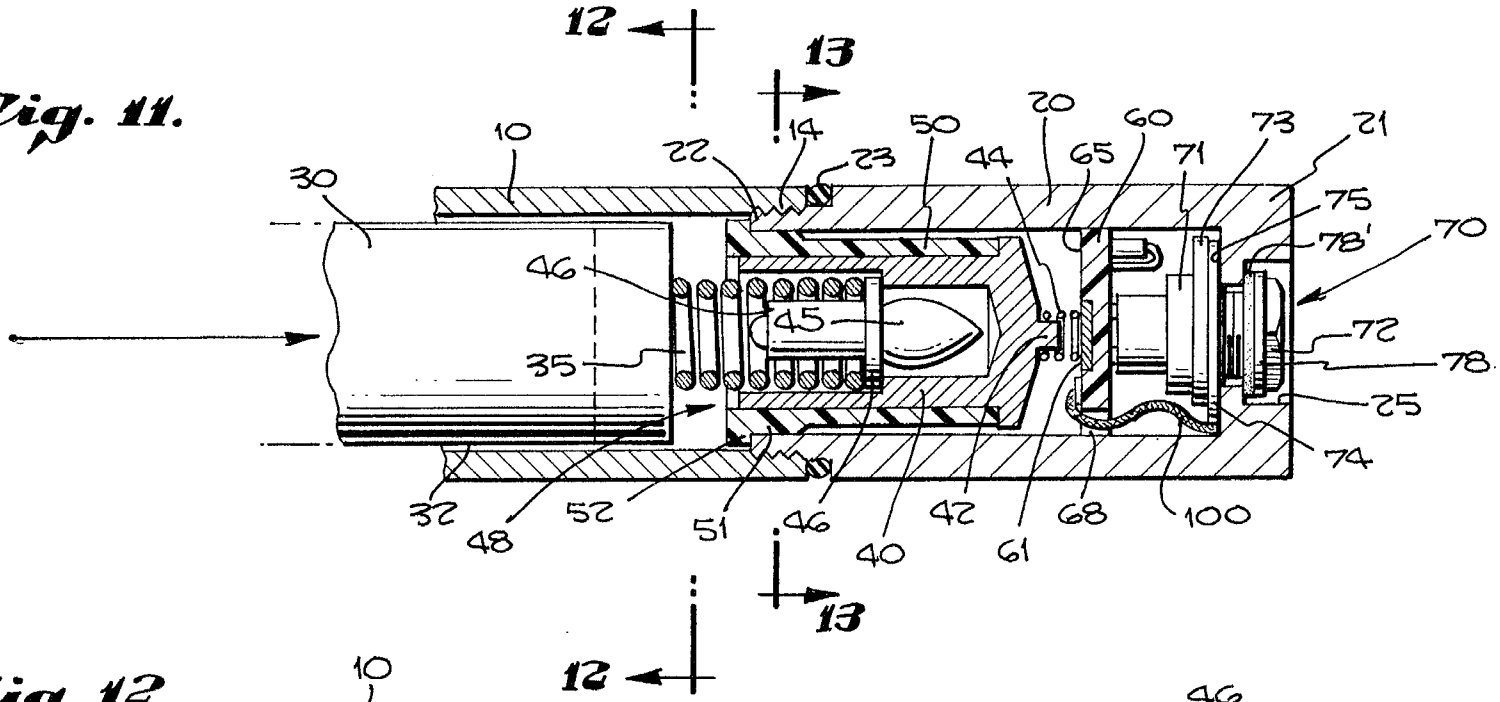
FIG. 11 is a cross sectional view of the tail cap of FIG. 1 showing the spring under normal stress.
Figure 13:
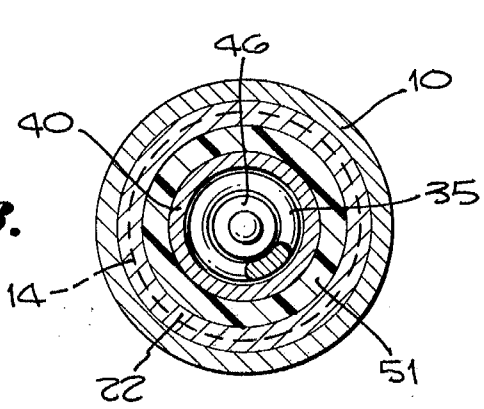
FIG. 13 is a cross sectional view of the tail cap assembly taken on line 13—13 of FIG. 11.
Figure 12:
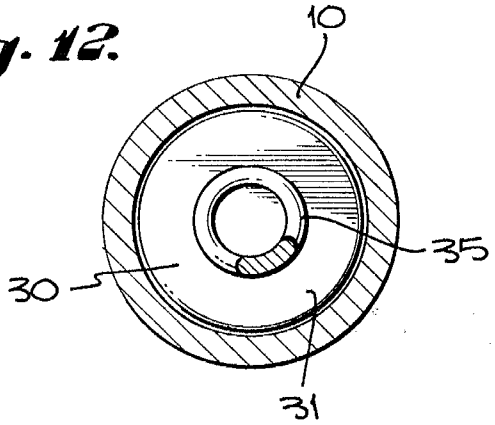
FIG. 12 is a cross sectional view of the flashlight taken on line 12—12 of FIG. 11 and showing the junction of battery and spring.

Mechanical interaction between the bulb holder assembly 48 and charger circuit assembly 77 can best be seen in FIGS. 2 and 11. Protuberance 42 projects rearward towards plate 61 on circuit board 60, but does not actually touch plate 61. Spring 44 is carried on protuberance 42 and presses against plate 61, providing a flexible connection that will absorb vibration and compensate for dimensional variances between components.

For the purpose of convenience, spring 35 may be described in the alternative as large spring 35. Also, spring 44 may be described as small spring 44.

The mechanical interaction between power plug 82 and switch assembly 70 will now be described in detail. By referring to FIG. 2, it can be seen that power plug 82 is slideably mounted within metal tube 76 of switch assembly 70 and can be removed when desired. As can be seen in FIG. 6, when power plug 82 is inserted into switch assembly 70 inner ring or sleeve 83 slides over center pin 115 making metallic contact. At the same time outer-sleeve 84 slides within metal tube 76 making metallic contact. Additionally, as outer sleeve 84 reaches the forward end of metal tube 76, it presses upward on flexible contact point 105 making metallic contact and simultaneously breaking the normal metallic connection between contact points 105 and 110.

MECHANICAL NON-INTERACTION

This invention has the unique feature of providing mechanical interaction between the charger unit and batteries while at the same time providing mechanical isolation between the batteries and the charger unit.

As previously discussed, the handling of a flashlight can cause the rearward movement of its batteries, which in turn causes compression of support spring 35. Normally, these rearward forces are absorbed by spring 35 and eventually are dissipated by the rear base cap of the flashlight. A unique problem develops when a charger unit is attached to the rear of a flashlight in place of the usual rear base cap. A charger unit is typically constructed of delicate electronic components that are vulnerable to these rearward forces. This invention provides a mechanical isolator in the form of the combination of tail cap 20 and bulb holder assembly 48. As shown in FIG. 2, the rearmost battery is in its normal position, that is, held at a distance from the bulb holder assembly 48 by the expansive force of spring 35. The rear end of spring 35 is rigidly supported by the metal flange 46 of bulb 45, or by shoulder 41 of bulb housing 40 when no spare bulb is being stored in cavity 47. Bulb housing 40 is of metal construction and is surrounded by sleeve 50. Sleeve 50 is constructed of a rigid insulating material and has an inside diameter so selected that it may be slideably mounted over bulb housing 40 in close relationship. Furthermore, the outside diameter of sleeve 50 at expanded portion 51 is so designed that it will act as a wedge between tail cap assembly 20 and bulb housing 40. Once the bulb housing assembly 48 is pressed into place, as an extra measure of precaution against rearward movement of the batteries, lip 52 seats against the forward end of tail cap 20. When the flashlight is handled, the rearward forces caused by the movements of the batteries are absorbed and dissipated through bulb holder assembly in the tail cap. This effect may be clearly seen in FIG. 11. Battery 30 has moved toward the tail end of the flashlight and has compressed spring 35. This force is transferred through bulb holder assembly 48 and into the walls of tail cap 20. Charger circuit assembly 77 lies beyond bulb holder assembly 48 and is therefore protected from any rearward forces.

OPERATION OF THE CHARGER CIRCUIT

Operation of the charger circuit assembly 77 will now be described in detail. As shown diagrammatically in FIG. 7, charger circuit assembly 77 is composed generally of switch assembly 70, integrated circuit 62, diodes 67 and 64. The flashlight-charger combination has two modes of electrical operation, a lighting mode and a charging mode. Selection of the desired mode is made by the insertion or non-insertion of plug 82 into receptacle 70. Depending upon which selection is chosen the electrical current will flow in different directions.

LIGHTING MODE

When the lighting mode is selected, that is, the charging plug has not been inserted, the flow of electrical current is as follows:

Beginning with battery 30 the current flows out negative terminal 31 into compression spring 35, then out of spring 35 into metal flange 46 of spare bulb 45, and then into bulb housing 40 through its shoulder 41. The current then passes through central protuberance 42 of bulb housing 40 and into spring 44 and hence into contact plate 61. Electrical current then flows through wire 79A, normally closed contacts 105 and 110, wire 79C, contact point 95 and wire 100, washer 74, end cap 20, body 10, switch 13, lamp 17 and finally returns to the positive terminal of battery 30.

CHARGING MODE

As shown in FIG. 6, when plug 82 is inserted into switch assembly 70 several operations occur that convert the lighting circuit into the charging circuit. When plug 82 is inserted into switch assembly 70, insulator sleeve 85 acts to guide the contact rings 83, 84 of plug 82 into metal tube 76. As plug 82 slides into switch assembly 70 the inner contact ring 83 engages center pin 115, which also acts to guide the plug 82. Specifically, inner ring 83 of plug 82 slides over center pin 115 providing mutual alignment and electrical contact. Concurrently, outer sleeve 84 of plug 82 makes slideable engagement with contact member 105 of switch assembly 70. In particular, as plug 82 slides into metal tube 76 the truncated leading edge 88 of insulator 85 comes into mechanical contact with the curved forward end 106 of contact 105. Plug 82 then causes contact member 105 to rise out of its normal position and to rest on sleeve 84. Simultaneously, when contact member 105 engages sleeve 84, it also disengages contact point 110 and they become electrically and mechanically separated.

Figure 7:
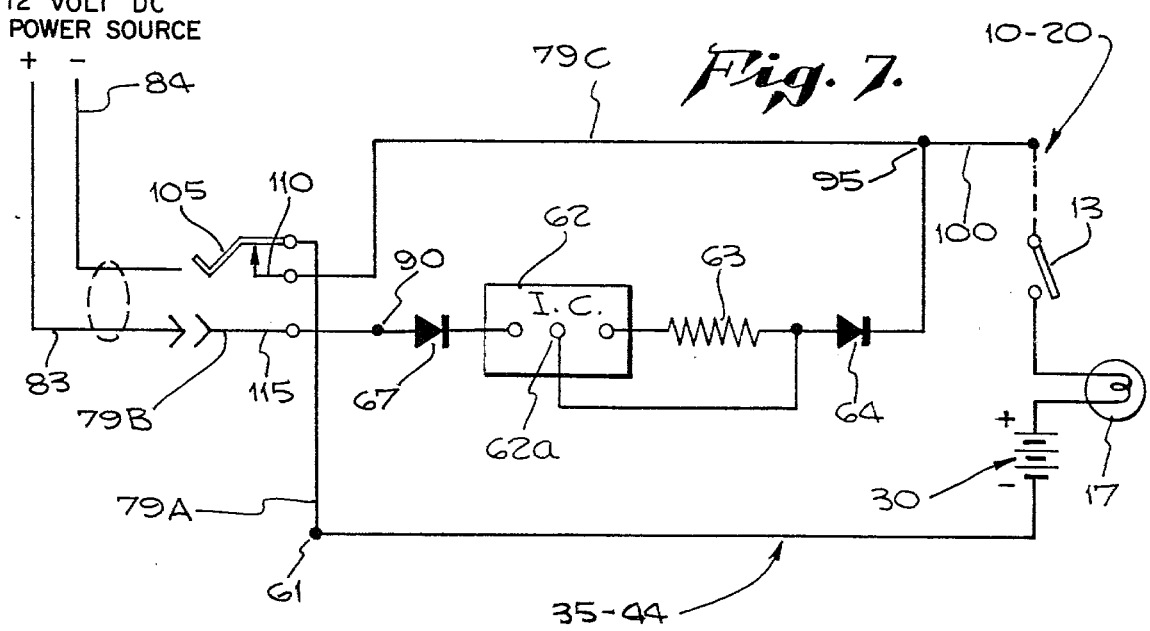
FIG. 7 is a schematic diagram of the entire electrical circuit of the flashlight of FIG. 1.

At this point in time as shown in FIG. 7 the lighting circuit has been converted into a charging circuit. The current flow within the charging circuit will now be described in detail.

It must be understood that since this is a charging circuit, the current flow is reversed relative to the lighting current so as to replenish the charges on the plates of batteries 30. The charging process begins with the charger current flowing from outer sleeve 84 of plug 82 and into the negative end of battery 30 by way of contact member 105, wire 79A and plate 61. Charging current then flowing in reverse to the lighting current passes through batteries 30, and via lamp 17, switch 13, body 10 and wire 100 into plate 95. From plate 95 current then flows through diode 64 and into terminal **62*a* of integrated circuit 62. Within integrated circuit-62 the current is regulated by resistor 63 in order to adjust the charging circuit depending upon the amount of charge needed. Current returns to the positively charged inner ring 83 of plug 82 by way of diode 67, wire 79B and center pin 115. As battery 30 becomes fully charged, the charging current automatically tapers off until no current is flowing. At that point plug 82 can be removed from switch assembly 70 and contact points 105 and 110** become reconnected. Lighting current flow then returns to its normal state.

SECOND EMBODIMENT

Reference is now made to drawings FIGS. 8–10, inclusive, illustrating a second embodiment of the invention, which is a self-contained rechargeable flashlight using size "D" batteries.

As shown in FIG. 8, the assembled flashlight includes a forward section 110 contains a plurality of batteries and a rear tail cap assembly 120. For convenience of illustration, only the rear portion of the flashlight is shown in FIG. 9, reflecting the rear portion of body 110, bulb holder assembly 48 and tail cap assembly 120.

The second embodiment of the invention is different from the first embodiment in that the diameter of the tail cap is greater due to the larger "D" type batteries. An adjustment is made in the dimensions of the tail cap walls to compensate for the larger diameter.

As illustrated in FIG. 9, battery 130 is the rearmost battery in the train of batteries in section 110 of the flashlight. Battery 130 is of the "D" type and has a greater diameter than battery 30 in the first embodiment. Body 110 is made appropriately larger in order to accommodate the "D" type battery. In order to match the increase in diameter of body 110, the outside diameter of tail cap 120 is incresed a like amount. As shown in FIG. 9, bulb holder assembly 48, charger assembly 77, and switch assembly 70 are identical to the assemblies that are used in the first embodiment and as a consequence compensation is made by increasing the thickness of tail cap 110 walls. Wall 128 surrounding bulb holder assembly 48 is of such size that it will tightly grip sleeve 50, thus preventing any rearward movement of assembly 48. Likewise, lip 52 rests on the forward end of tail cap 120 preventing any rearward movement of bulb holder assembly 48. Obviously, the same compensation could be achieved by maintaining the same thickness of wall 128 and increasing the thickness of sleeve 50.

In the rearward section of tail cap assembly 120 charger circuit 77 is located within cavity 126 and is identical to the assembly used in the first embodiment. In order to compensate for the increased diameter of tail cap 120 tail cap wall 122 is increased in thickness to such an extent that tail cap cavity 126 will accommodate charger assembly 77. As shown in FIG. 9, switch assembly 70 is identical to the switch assembly used in the first embodiment, as is opening 126 and bore 125.

THIRD EMBODIMENT

Figure 14:
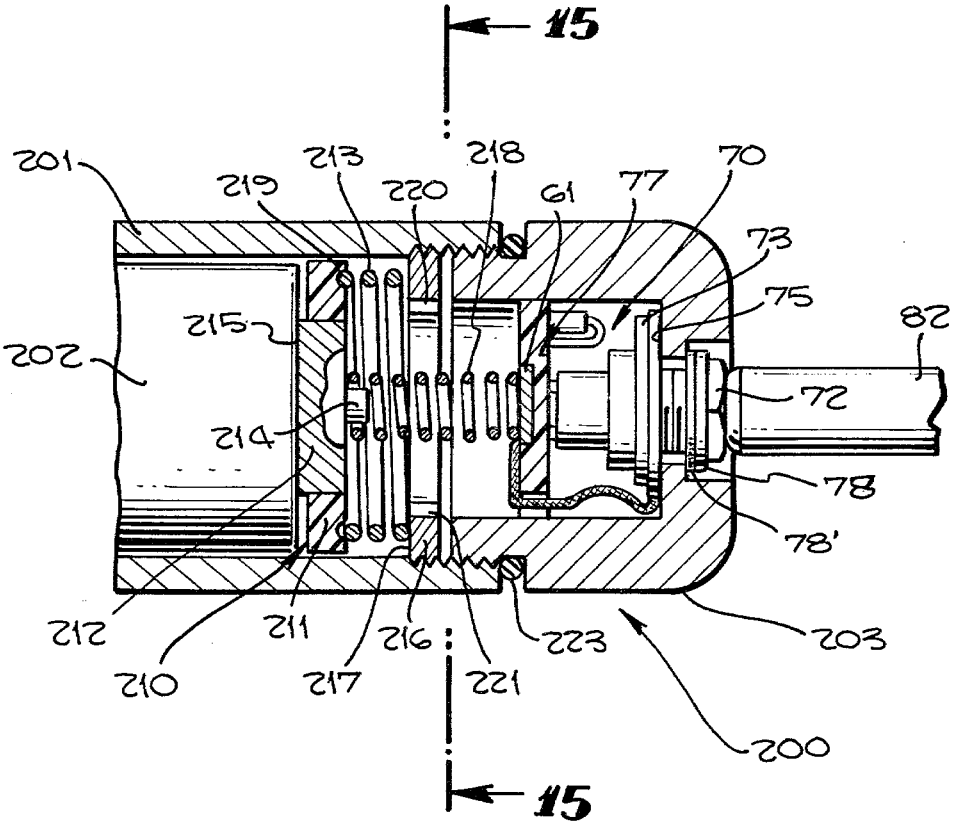
FIG. 14 is a cross sectional elevational view of a third embodiment of the tail cap assembly.
Figure 15:
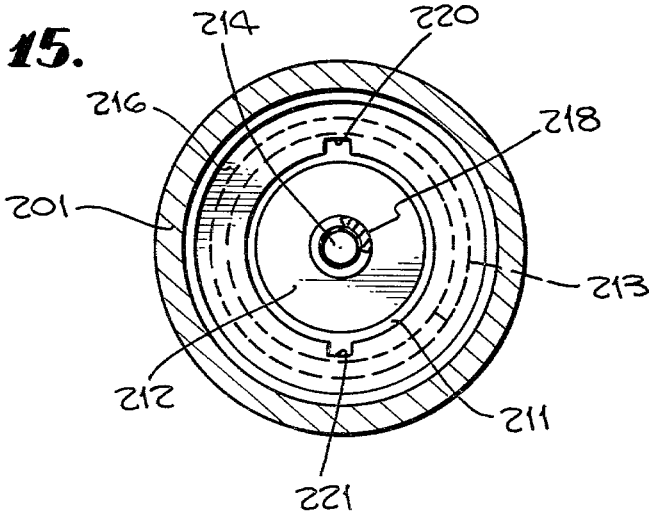
FIG. 15 is a fragmentary cross sectional view of the tail cap assembly taken on line 15—15 of FIG. 14.

(FIGS. 14 and 15)

As taught by the first and second embodiments one of the purposes of my invention is to provide mechanical non-interaction between the movement of the batteries and the delicate electronic components. That was accomplished by providing a mechanical isolator means within the tail cap assembly. The purpose of this third embodiment is to provide the same mechanical non-interaction within the body of the flashlight, totally removed from the tail cap.

As shown in FIG. 14, the third embodiment is composed of a modified tail cap assembly 200 and wafer assembly 210. Tail cap assembly 200 is similar to the tail cap in the first two embodiments in that it has the same outside and inside diameters; it contains the same switch assembly; it contains the same charger circuit assembly and is threadedly mounted to the flashlight body 201 in the same manner. Tail cap assembly 200 is modified in that the length of the tail cap has been shortened relative to tail caps 20 and 120, so that it need only accommodate charger circuit assembly 77 and switch assembly 70, with the spare bulb and its holder being omitted.

In the third embodiment mechanical isolation is no longer achieved by use of the bulb holder assembly, which has now been removed, but is provided by wafer assembly 210 which is mounted within the flashlight body 201. As seen in FIG. 14, wafer assembly 210 is composed of wafer 211 which is constructed of rigid insulating material around its outer periphery and an inner core 212 which is a conductive material. Inner core 212 has forward end 215 which extends slightly above the surface of wafer 211, so that core 212 may make secure electrical contact with the rear of battery 202. Core 212 rearward surface has a centrally located protuberance 214 which provides a mounting for metallic connecting spring 218. Connecting spring 218 is so designed that its length will extend from the rearward surface of inner core 212 to plate 61 on charger circuit assembly 77. A support spring 213 is much more heavily constructed than spring 218 and is so designed that its forward end may be mounted within annular groove 219 located within the rear surface of wafer 211. The rearward portion of spring 213 rests against surface 217 of retainer 216. Retainer 216 is a metal ring which is threadedly mounted within body 201 by inserting a tool within slots 220 and 221, FIG. 15.

In operation, wafer assembly 210 provides an electrical connection between batteries 202 and the charger circuit assembly 77 by way of core 212, protuberance 214 and spring 218. Wafer assembly 210 provides mechanical non-interaction by having support spring 213 absorb shock forces that may occur by the rearward movements of batteries 202. These forces are absorbed by spring 213 and dissipated by retainer 216 into the walls of body 201, thus preventing any shock to the charger circuit assembly.

OTHER MODIFICATIONS

While only two embodiments of the isolator mechanism have been shown it will be understood that other equivalent forms are within the scope of the invention.

Although it is presently preferred to utilize a metal housing and metal tail cap for the flashlight, one or both of these parts may if desired be made of another material such as plastic, and corresponding design modifications may then be made to carry out the purposes of the invention.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

I claim:

1. A tail cap assembly for use in converting an ordinary flashlight into a rechargeable flashlight, said tail cap assembly comprising, in combination:

a metal cap member of generally cup-shaped configuration, having an open end and a closed end wall, said cap member being threaded at its open end;

a switch means supported within said metal cap member and having a dual-contact female switch receptacle accessible through said end wall for the insertion of a male power plug therein;

a compression spring supported substantially concentric to said cap member, having an inner end disposed within said cap member and an outer end which protrudes from the open end of said cap member;

conductive means including said switch means within said metal cap member adapted to provide a normal current pathway between said cap member and the inner end of said compression spring;

said switch means being responsive to the insertion of a power plug into said switch receptacle to interrupt said normal current pathway;

charging circuit means including at least one rectifier and current regulating means disposed within said cap member and cooperating with said switch means when said normal current pathway is interrupted for supplying a charging voltage between said cap member and said inner end of said compression spring; and said switch means, charging circuit means, and conductive means being wholly contained within the confines of said cap member and securely supported therein, whereby after ordinary batteries have been replaced with rechargeable batteries inside the flashlight housing, the entire recharging apparatus may then be incorporated into the flashlight by threadedly securing said metal cap member to the flashlight housing, which action concurrently presses the outer end of said compression spring into conductive engagement with the rearmost battery in the housing.

2. The tail cap assembly of claim 1 wherein said end wall of said metal cap member has a central opening therein, the outer surface of said end wall is countersunk to form a recess extending about said central opening, and said switch receptacle is partially disposed within said central opening and secured to the adjacent portion of said end wall.

3. The tail cap assembly of claim 1 which further includes isolation means for mechanically isolating said charging circuit means from said compression spring so that a rearward movement of the flashlight batteries is absorbed by said compression spring without causing damage to said charging circuit means.

4. The tail cap assembly of claim 3 which further includes a spare bulb holder assembly, said spare bulb holder assembly also constituting said isolation means.

5. In a tail cap assembly for a flashlight, a spare bulb assembly comprising, in combination:

a single metallic member providing a bulb housing, said housing member being of generally cup-shaped configuration, having a larger interior diameter at its open end than at its closed end, and hvaing at about the midpoint of its length a circumferential interior shoulder which faces toward its open end;

a flashlight bulb having a glass bulb member, a cylindrical metal base member enclosing one end portion of said bulb member, and a circumferentially extending metal support flange which protrudes from said metal base member at about the longitudinal center of said bulb member;

said bulb being received within said housing member with said metal flange of said base member in supporting engagement with said shoulder of said housing;

the open end of said housing enclosing the associated end of said bulb; and a hollow cylindrical insulating member disposed about said housing member, said insulating member having an annular exterior shoulder at the open end of said housing member.

6. A rechargeable flashlight comprising, in combination:

a main housing;

at least one rechargeable battery disposed within said main housing;

a tail cap member of generally cup-shaped configuration having its open end secured to one end of said main housing;

a charging circuit disposed within said tail cap member, said charging circuit including at least one rectifier and current regulating means;

means for selectively coupling an external power source to said charging circuit;

a compression spring of relatively large diameter, being normally partially compressed and having one end supporting said battery, the other end of said large spring extending toward said charging circuit;

mechanical isolation means cooperating with said one end of said main housing and supporting the other end of said large spring against movement, whereby any movement of said battery toward said charging circuit is absorbed by said large spring without causing damage to said charging circuit;

a compression spring of relatively small diameter, being disposed substantially concentric to said large spring, said small spring being also normally compressed and having one end in conductive engagement with said charging circuit; and means conductively coupling the other end of said small spring to said battery;

said small spring being operable to compensate for mechanical part tolerances without interruption of an electrical pathway between said battery and said charging circuit.

7. A rechargeable flashlight as in claim 6 wherein said mechanical isolation means is supported at least in part from said tail cap member.

8. A rechargeable flashlight as in claim 6 wherein said mechanical isolation means is supported at least in part from said main housing.

9. A rechargeable flashlight as in claim 6 which further includes a spare bulb holder assembly, said spare bulb holder assembly also constituting said mechanical isolation means.

10. A rechargeable flashlight as in claim 9 wherein said large and small springs are spaced longitudinally apart, said spare bulb holder assembly being positioned between them.

11. A rechargeable flashlight comprising, in combination:

a housing;

rechargeable batteries inside said housing;

an electronic circuit disposed within said housing for recharging said batteries;

switch means disposed within said housing and selectively operable for actuating said electronic circuit and for coupling an external power source thereto; and means mechanically isolating said electronic circuit and said switch means from said batteries so as to protect them from damage that might otherwise be caused by physical movements of the batteries relative to the housing.

* * * * *